US012089751B2

(12) United States Patent
Ohshima et al.

(10) Patent No.: US 12,089,751 B2
(45) Date of Patent: Sep. 17, 2024

(54) CHAIR, SEAT PORTION, AND BACKREST

(71) Applicant: NATURE ARCHITECTS INC., Tokyo (JP)

(72) Inventors: Taisuke Ohshima, Tokyo (JP); Ryu Yamamoto, Tokyo (JP); Koki Sato, Tokyo (JP); Keisuke Tanaka, Tokyo (JP); Naoki Uehara, Tokyo (JP)

(73) Assignee: NATURE ARCHITECTS INC., Tokyo (JP)

( * ) Notice: Subject to any disclaimer, the term of this patent is extended or adjusted under 35 U.S.C. 154(b) by 157 days.

(21) Appl. No.: 17/791,630

(22) PCT Filed: Jan. 7, 2021

(86) PCT No.: PCT/JP2021/000275
§ 371 (c)(1),
(2) Date: Jul. 8, 2022

(87) PCT Pub. No.: WO2021/141073
PCT Pub. Date: Jul. 15, 2021

(65) Prior Publication Data

US 2023/0031880 A1 Feb. 2, 2023

(30) Foreign Application Priority Data

Jan. 9, 2020 (JP) ..... 2020-001891

(51) Int. Cl.
*A47C 7/02* (2006.01)

(52) U.S. Cl.
CPC ..... *A47C 7/02* (2013.01)

(58) Field of Classification Search
CPC ..... A47C 7/02
See application file for complete search history.

(56) References Cited

U.S. PATENT DOCUMENTS

| | | | | |
|---|---|---|---|---|
| 4,607,882 | A * | 8/1986 | Opsvik | A47C 9/002 297/195.11 |
| 2005/0022306 | A1* | 2/2005 | Hetzel | A47C 7/029 5/654 |
| 2012/0299350 | A1* | 11/2012 | Willingham | A47C 7/029 297/313 |

FOREIGN PATENT DOCUMENTS

| | | | |
|---|---|---|---|
| DE | 102017001503 | A1 * | 8/2018 |
| JP | 2015016232 | A | 1/2015 |
| JP | 2015134085 | A | 7/2015 |
| JP | 2017121334 | A | 7/2017 |
| JP | 2018191807 | A | 12/2018 |
| JP | 2019063177 | A | 4/2019 |

OTHER PUBLICATIONS

International Search Report for International Application No. PCT/JP2021/000275; Date of Mailing, Mar. 23, 2021.

* cited by examiner

*Primary Examiner* — Anthony D Barfield
(74) *Attorney, Agent, or Firm* — CANTOR COLBURN LLP

(57) ABSTRACT

A first aspect of the present disclosure provides a chair. This chair is provided with a seat portion in which a deformation mode of at least a portion of a seating surface of the seat portion is isolated in such that a target curved surface including a double-curved surface of a prescribed type, relative to a prescribed position, is formed irrespective of the position of the buttocks of a user when the user is seated.

10 Claims, 17 Drawing Sheets

CHAIR, SEAT PORTION, AND BACKREST

CROSS REFERENCE TO RELATED APPLICATIONS

This is the U.S. national stage of application No. PCT/JP2021/000275, filed on Jan. 7, 2021. Priority under 35 U.S.C. § 119(a) and 35 U.S.C. § 365(b) is claimed from Japanese Application No. 2020-001891, filed Jan. 9, 2020, the disclosure of which is also incorporated herein by reference.

TECHNICAL FIELD

The present disclosure relates to a chair, a seat portion and a backrest.

BACKGROUND ART

In recent years, the number of office workers who can select the place to perform their work in addition to fixed seats provided in the office has been increasing against a backdrop of Work Style Reform. Such office workers typically perform their work in shared office areas (for example, cafe spaces), co-working spaces, shared offices, their own houses, and the like. In these spaces, casual chairs with simple designs that are hardly associated with the office are preferred.

In comparison with high-functional task chairs often seen at fixed seats in conventional offices, however, common casual chairs do not assume long-time sitting and therefore provide an uncomfortable sitting feeling, and further it is difficult to add various mechanical adjustment mechanisms thereto due to design constraints.

Patent Literature (hereinafter referred to as "PTL") 1 proposes a chair on which a seated person can be comfortably seated. PTL 2 proposes a chair which is supposed to be capable of achieving an improved sitting feeling.

CITATION LIST

Patent Literature

PTL 1

Japanese Patent Application Laid-Open No. 2018-191807

PTL2

Japanese Patent Application Laid-Open No. 2015-016232

SUMMARY OF INVENTION

Technical Problem

In the chair described in PTL 1, two recesses for the ischium for accommodating a protrusion(s) of the ischium are formed on a seating surface of a seat plate of the chair. Accordingly, it is a prerequisite for the design of the chair to form the recesses for the ischium as such in order to pursue a comfortable sitting feeling by utilizing the technique described in PTL 1.

In the chair described in PTL 2, supporting structures which are attached to frames of the chair and support the buttocks or back surface portion of a seated person are provided with stoppers which prevent the seated person from moving. Accordingly, it is a prerequisite for the design of the chair to provide the stoppers in order to pursue a comfortable sitting feeling by utilizing the technique described in PTL 2.

An object of the present disclosure is to provide a chair with a high degree of freedom in design and a comfortable sitting feeling.

Solution to Problem

A first aspect of the present disclosure provides a chair including a seat portion in which a deformation mode of at least a portion of a seating surface is isolated such that a target curved surface including a double-curved surface of a prescribed type, relative to a prescribed position, is formed irrespective of a position of buttocks of a user when the user is seated.

A second aspect of the present disclosure provides a chair including: a seat portion; and a backrest in which a deformation mode of at least a portion of a back contact surface is isolated such that a first target curved surface including a double-curved surface of a first type, relative to a first position, is formed irrespective of a position of a back of a user when the user leans on the backrest.

A third aspect of the present disclosure provides a seat portion in which a deformation mode of at least a portion of a seating surface is isolated such that a target curved surface including a double-curved surface of a prescribed type, relative to a prescribed position, is formed irrespective of a position of buttocks of a user when the user is seated.

A fourth aspect of the present disclosure provides a backrest in which a deformation mode of at least a portion of a back contact surface is isolated such that a target curved surface including a double-curved surface of a prescribed type, relative to a prescribed position, is formed irrespective of a position of a back of a user when the user leans on the backrest.

Advantageous Effects of Invention

According to the present disclosure, it is possible to provide a chair with a high degree of freedom in design and a comfortable sitting feeling.

DESCRIPTION OF EMBODIMENTS

Hereinafter, an embodiment will be described in detail with reference to the accompanying drawings. Note that, the same or similar reference signs are attached to the same or similar elements as or to those already described, and duplicate descriptions are basically omitted.

In the following description, a left-right direction, a front-rear direction and an up-down direction as viewed from a chair are defined as the X direction, the Y direction and the Z direction, respectively.

(1) Configuration of Chair

Figure 1:
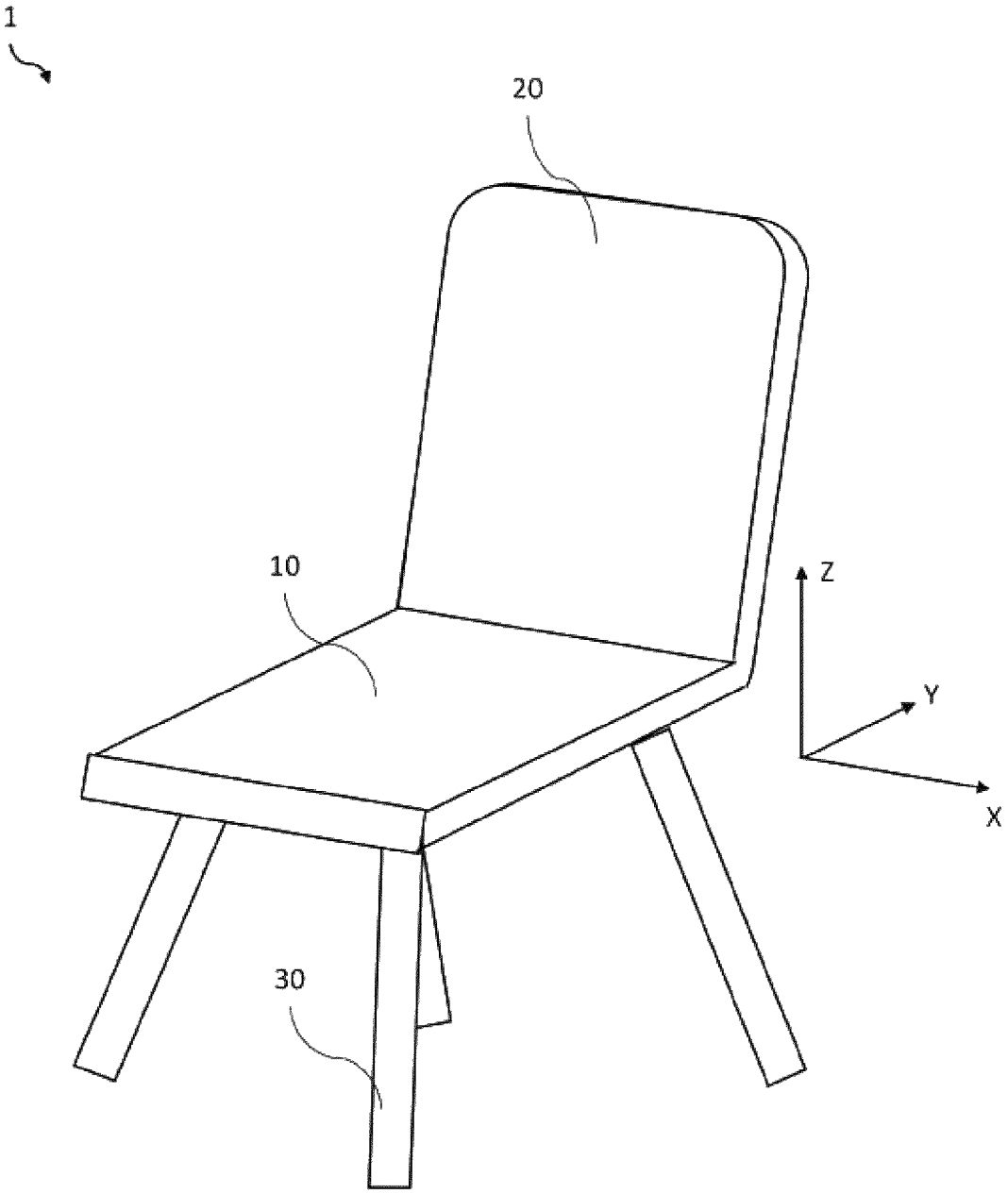
FIG. 1 is a diagram illustrating an exemplary configuration of a chair according to the present embodiment.

A configuration of a chair according to the present embodiment will be described. FIG. 1 is a diagram illustrating an exemplary configuration of a chair according to the present embodiment.

A chair 1 in FIG. 1 includes a seat portion 10, a backrest 20 and legs 30.

The seat portion 10 supports the buttocks of a user when the user is seated. The seat portion 10 includes a structure described below. This structure is designed to form a certain curved surface by predetermined motion (displacement) of a predetermined part of the structure through elastic deformation against a force applied to the structure. Such a mechanism of predetermined motion of a structure through elastic deformation against a force applied to the structure may also be referred to as a compliant mechanism. This structure has low rigidity (that is, is easily deformed) against a force in a direction which contributes to the formation of a certain curved surface and, on the other hand, has high rigidity (that is, is hardly deformed) against a force in a direction which does not contribute to the formation of the curved surface. In other words, the deformation mode of this structure is isolated. Thus, the structure can form a certain curved surface in accordance with the design thereof irrespective of the position, direction and magnitude of a force applied to the structure.

The structure included in the seat portion 10 may be produced by utilizing, for example, at least one of formation with a 3D printer, injection molding, powder compression molding, laser processing and cutting processing. The structure may include, for example, at least one of resin, metal (for example, iron or aluminum) and wood as a material.

The structure may be exposed to the outside or may be covered by a surface material. By covering the structure with the surface material, the chair 1 can be designed irrespective of the external appearance of the structure. The surface material is constituted by a material which does not inhibit elastic deformation of the structure, such as a soft material such as an elastomer, fabric (woven fabric, knitted fabric, or non-woven fabric) and leather (natural leather or artificial leather). The base material of an elastomer as the surface material is not particularly limited, but may be, for example, an acrylic, urethane, silicon, or styrene base material.

The backrest 20 supports the back of a user when the user leans on the backrest 20. The backrest 20 includes a structure described below. This structure is designed, in the same manner as in the structure of the seat portion 10, to form a certain curved surface by predetermined motion (displacement) of a predetermined part of the structure through elastic deformation against a force applied to the structure. The deformation mode of this structure is isolated. Thus, the structure can form a certain curved surface in accordance with the design thereof irrespective of the position, direction and magnitude of a force applied to the structure.

The structure included in the backrest 20 may be produced by utilizing, for example, at least one of formation with a 3D printer, injection molding, powder compression molding, laser processing and cutting processing. The structure may include, for example, at least one of resin, metal (for example, iron or aluminum) and wood as a material.

The structure may be exposed to the outside or may be covered by a surface material. By covering the structure with the surface material, the chair 1 can be designed irrespective of the external appearance of the structure. The surface material is constituted by a material which does not inhibit elastic deformation of the structure, such as a soft material such as an elastomer, fabric (woven fabric, knitted fabric, or non-woven fabric) and leather (natural leather or artificial leather). The base material of an elastomer as the surface material is not particularly limited, but may be, for example, an acrylic, urethane, silicon, or styrene base material.

Both or only one of the seat portion 10 and the backrest 20 may be produced separately or both may be produced integrally as a chair. In a case where both the seat portion 10 and the backrest 20 are produced separately, a chair in which the seat portion 10 and the backrest 20 that have been produced separately are joined may be used. Alternatively, a chair in which the seat portion 10 that has been produced separately is not joined to the backrest 20 may be used or a chair in which the backrest 20 that has been produced separately is not joined to the seat portion 10 may be used. Further, at least one of the seat portion 10 and the backrest 20 may be removable from a chair.

At least one of the seat portion 10 and the backrest 20 may be attached to a frame (not illustrated) via a joint portion for improved stability. The frame may include, for example, at least one of resin, metal (for example, iron or aluminum) and wood as a material. Further, the resin may be a fiber-reinforced resin such as a carbon fiber-reinforced plastic, a glass fiber-reinforced nylon (PAGF) and a fiber-reinforced polypropylene resin. The joint portion may include, for example, a soft material such as an elastomer.

The legs 30 support the seat portion 10 and the backrest 20. The legs 30 may be produced integrally with the frame (not illustrated). Alternatively, the legs 30 may be produced separately from the frame and then may be attached to the frame.

Although the number of legs 30 in the example of FIG. 1 is four, the number thereof may be three or less or may be five or more. Grounding surface-side end portions of a plurality of the legs 30 among the legs 30 may be connected to each other. Thus, it is possible to increase the stability of the chair 1 and/or to configure the chair 1 as a rocking chair. In addition, casters may be attached to the legs 30. Further, the legs 30 may be dispensed with in a case where the chair 1 is configured as a legless chair.

(2) Summary of Embodiment

The seat portion 10 has a structure designed such that a curved surface serving as a target (hereinafter referred to as "target curved surface") and including a double-curved surface of a prescribed type, relative to a prescribed position, is formed by elastic deformation of a seating surface in response to an external force from a user irrespective of the position of the buttocks of the user when the user is seated. The target curved surface of the seating surface is the final shape of the seating surface, which is reached by elastic deformation against the application of the external force. The target curved surface of the seating surface depends on the structure of the seat portion 10. In other words, the deformation mode of the seat portion 10 is isolated, and in the seat portion 10, the target curved surface is formed by the seating surface irrespective of the position of the buttocks of the user when the user is seated. The external force from the user acts, for example, via the buttocks of the user, which come into contact with the seat portion 10 when the user is seated. This double-curved surface envelops at least a portion of the buttocks of the user.

Here, the double-curved surface means a curved surface which does not fall under a developable surface and the Gaussian curvature of a point on which is nonzero. The double-curved surface is, for example, a bowl-type curved surface (whose definition will be described below), a saddle-type curved surface (whose definition will be described below), a spherical surface, or the like. The developable surface includes, for example, a portion or all of a surface selected from a plane, a cylindrical surface, a conical surface and a tangent curve. The Gaussian curvature is a geometric index that indicates how deviated a surface is from a plane.

The backrest 20 has a structure designed such that a target curved surface including a double-curved surface of a prescribed type, relative to a prescribed position, is formed by elastic deformation of a back contact surface in response to an external force from a user irrespective of the position of the back of the user when the user leans on the backrest 20. The target curved surface of the back contact surface is the final shape of the back contact surface, which is reached by elastic deformation against the application of the external force. The target curved surface of the back contact surface depends on the structure of the backrest 20. In other words, the deformation mode of the backrest 20 is isolated, and in the backrest 20, the target curved surface is formed by the back contact surface irrespective of the position of the back of the user when the user leans on the backrest 20. The external force from the user acts, for example, via the back of the user, which comes into contact with the backrest 20 when the user leans thereon. This double-curved surface envelops at least a portion of the back of the user.

As described above, the seat portion 10 of the chair 1 is elastically deformed by an external force received by the seat portion 10 when the buttocks of a user being seated come into contact with the seat portion 10 such that a seating surface having a double-curved surface shape, which itself envelops at least a portion of the buttocks, is formed. Further, the backrest 20 of the chair 1 is elastically deformed by an external force received by the backrest 20 when the back of a user comes into contact with the backrest 20 when the user leans thereon such that a back contact surface having a double-curved surface shape, which itself envelops at least a portion of the back, is formed.

In short, since the seat portion 10 and the backrest 20 themselves are elastically deformed such that target curved surfaces that fit the human body are formed, respectively, this chair 1 is neither required to force the seat portion or the backrest to have a specific shape nor required to add a certain mechanical mechanism in order to improve a sitting feeling. That is, according to the present embodiment, it is possible to provide the chair 1 with a high degree of freedom in design and a comfortable sitting feeling.

Note that, as will be described below in Variation 1, it is possible to provide a chair with a high degree of freedom in design and a comfortable sitting feeling even when the seat portion 10 is replaced with an existing seat portion or the backrest 20 is replaced with an existing backrest or even when the chair to which the seat portion 10 is applied includes no backrest.

Further, although it has been described that the seating surface of the seat portion 10 is deformed such that a target curved surface is formed, the entire seating surface is not required to be deformed, but a portion of the seating surface may be deformed. Similarly, although it has been described that the back contact surface of the backrest 20 is deformed such that a target curved surface is formed, the entire back contact surface is not required to be deformed, but a portion of the back contact surface may be deformed.

Figure 2:
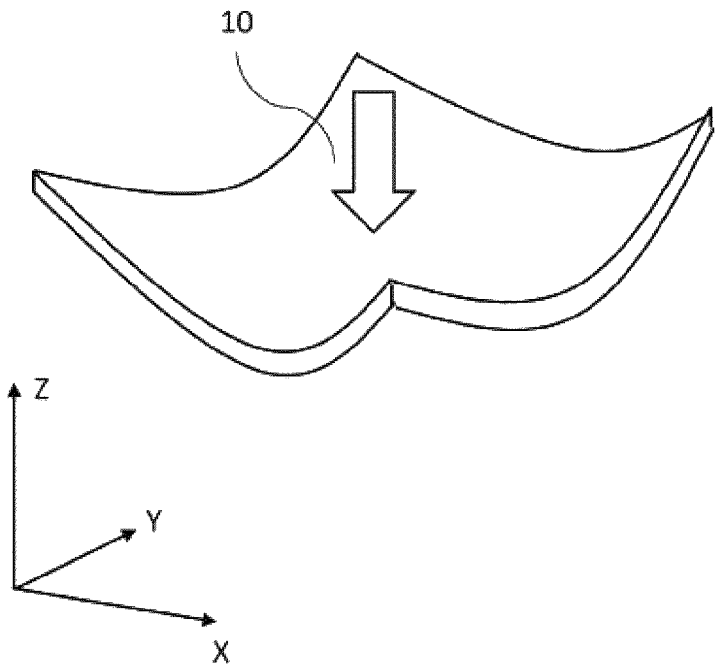
FIG. 2 is a diagram illustrating an exemplary three-dimensional shape of a seat portion when a user is seated.
Figure 3:
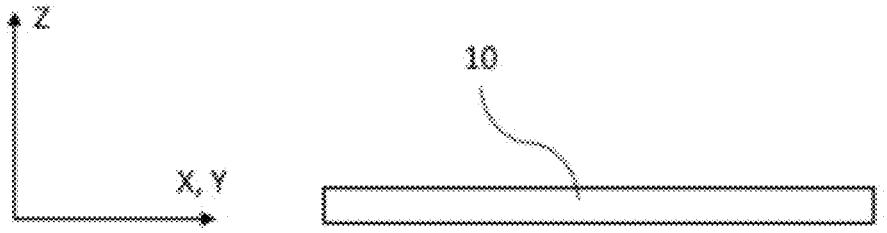
FIG. 3 is a diagram illustrating an exemplary YZ or ZX cross-sectional shape of the seat portion when the user is not seated.
Figure 4:
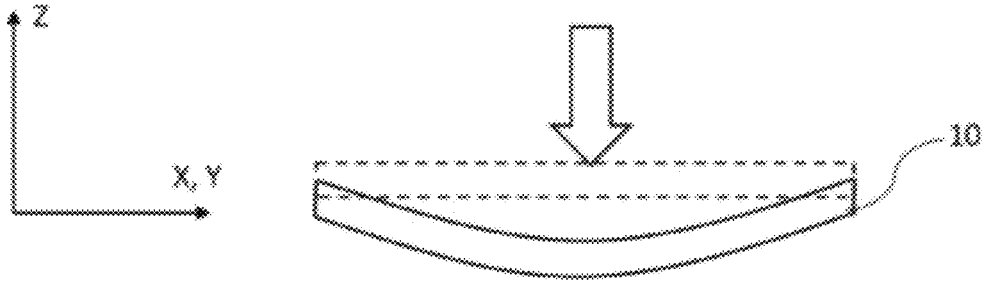
FIG. 4 is a diagram illustrating an exemplary YZ or ZX cross-sectional shape of the seat portion when the user is not seated.

(3) Seat Portion and Backrest (3-1) Seat Portion (3-1-1) Deformation of Seat Portion The deformation of the seat portion 10 will be described. FIG. 2 is a diagram illustrating an exemplary three-dimensional shape of the seat portion when a user is seated. FIG. 3 is a diagram illustrating an exemplary YZ or ZX cross-sectional shape of the seat portion when the user is not seated. FIG. 4 is a diagram illustrating an exemplary YZ or ZX cross-sectional shape of the seat portion when the user is not seated.

As illustrated in FIGS. 2 to 4, the seat portion 10 is deformed into a substantially bowl-type double-curved surface in response to an external force from a user when the user is seated.

The curvature of this double-curved surface depends on the magnitude (absolute value) of a normal direction-component (indicated by the arrows in FIGS. 2 and 4) of the external force from the user when the user is seated, with respect to a reference surface of a seating surface. In the examples of FIGS. 2 to 4, the reference surface of the seating surface is the XY plane so that the normal direction with respect to the reference surface is the Z direction. This double-curved surface is relative to a position that depends on mechanical properties of the structure of the seat portion 10 irrespective of the position of the buttocks of the user. In short, the seat portion 10 is deformed into a bowl-type double-curved surface having a larger positive value of Gaussian curvature as the Z direction-component of the external force from the user becomes larger. The bowl-type double-curved surface means a double-curved surface at every point on which the Gaussian curvature is positive.

As illustrated in FIGS. 3 and 4, the seating surface has the largest deformation (sinking) near the center and the deformation becomes smaller toward the periphery so that the buttocks of the user are well fitted. The seat portion 10 as such, which causes the seating surface to look flat or look like any other arbitrary surface shape when the user is not seated, makes it possible to produce a comfortable sitting feeling, in particular a fitting feeling to the buttocks of the user, by enveloping (at least a portion of) the buttocks when the user is seated.

The target curved surface formed by the seating surface may include a plurality of curved surfaces relative to different positions. For example, the seating surface may form a target curved surface including: a substantially bowl-type first double-curved surface that envelops at least a portion of the right buttock; and a substantially bowl-type second double-curved surface that envelops at least a portion of the left buttock. The target curved surface may include not only a bowl-type double-curved surface(s) but also a saddle-type double-curved surface(s) or any other-type double-curved surface(s). The target curved surface means a curved surface including at least one double-curved surface and may further include a developable surface(s) in addition to a double-curved surface(s). That is, in the target curved surface, positive, negative, or zero Gaussian curvatures may be mixed. A curved surface with zero Gaussian curvature corresponds to a developable surface.

(3-1-2) Structure of Seat Portion

Figure 5:
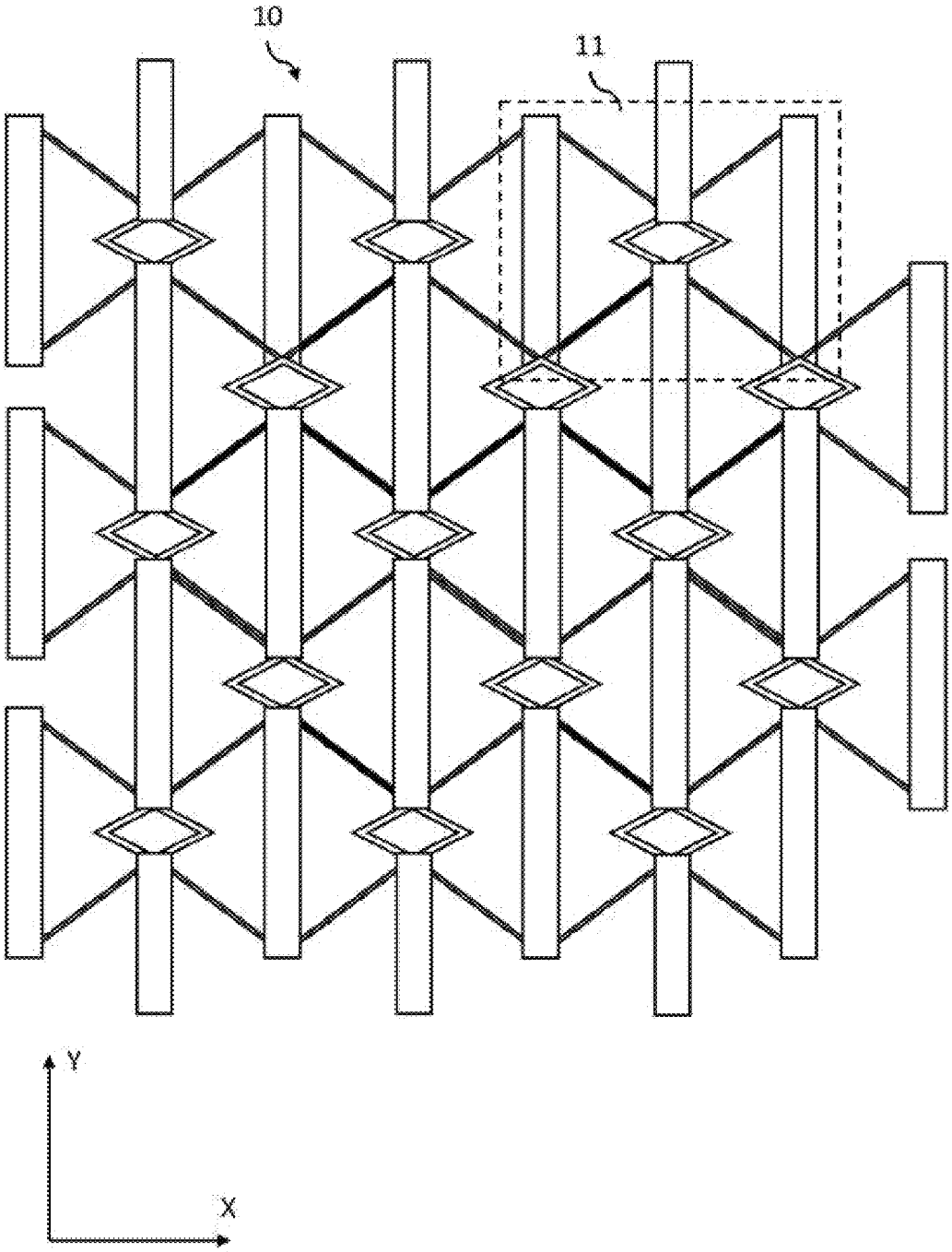
FIG. 5 is a diagram illustrating an exemplary structure included in the seat portion.
Figure 6:
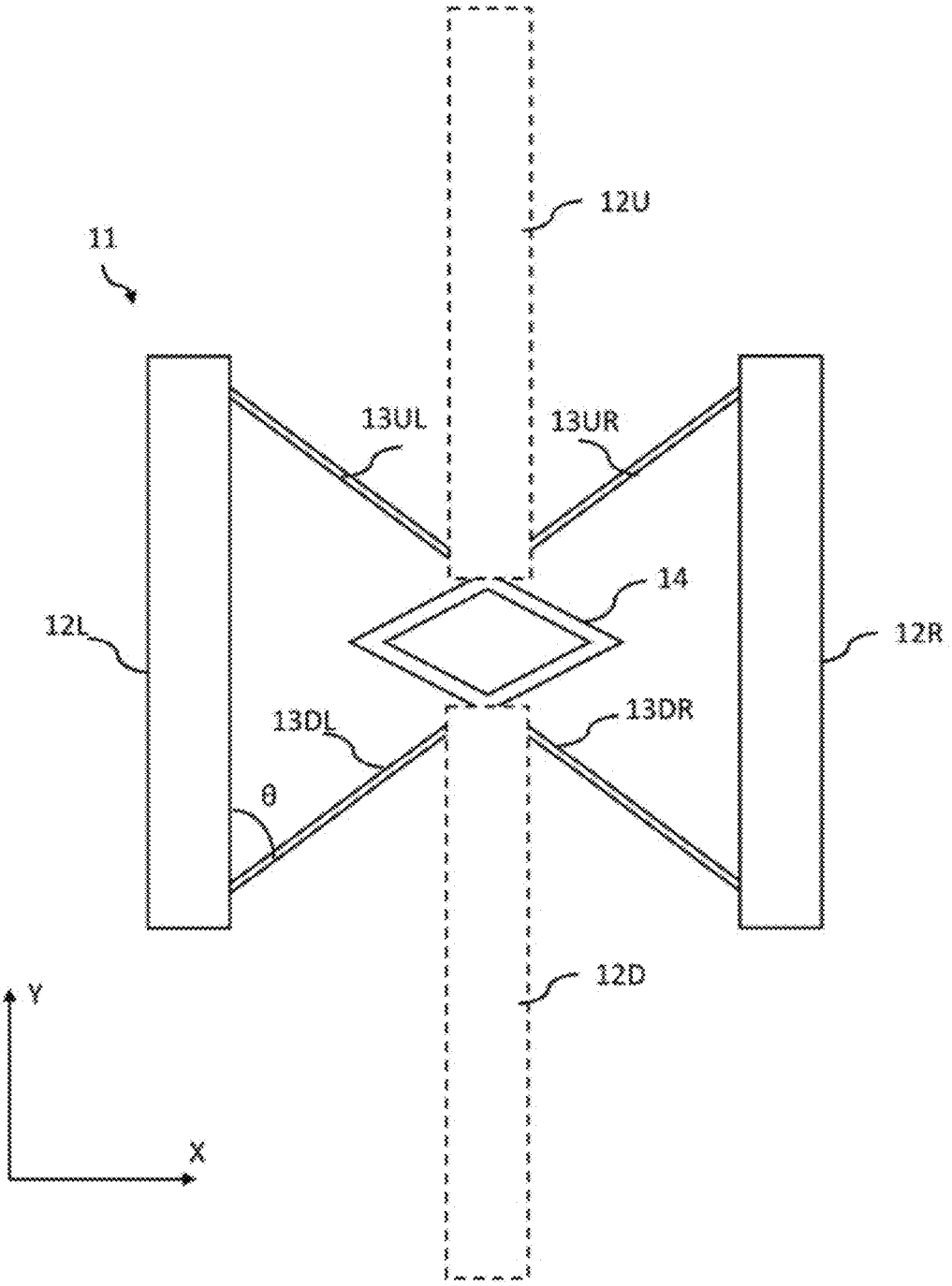
FIG. 6 is a diagram illustrating an exemplary unit structure that constitutes the structure included in the seat portion.

The structure included in the seat portion 10 will be described. This structure realizes the deformation described in (3-1-1) above. FIG. 5 is a diagram illustrating an exemplary structure included in the seat portion. FIG. 6 is a diagram illustrating an exemplary unit structure that constitutes the structure included in the seat portion.

The structure in FIG. 5 is obtained by continuously arranging unit structures 11, one of which is illustrated in FIG. 6, along a reference surface of the seat portion 10, which is the XY plane in this example. Note that, it may also be configured such that structures are arranged in a portion (for example, the central portion) of the seat portion 10 and are not arranged in the remaining portion (for example, the end portions) of the seat portion 10. This structure can realize human-intended mechanical properties (that is, the deformation described in (3-1-1) above) by a repetitive structure of unit structures. Such a structure may also be referred to as a mechanical metamaterial. Note that, the repetitive structure of unit structures may be produced by utilizing, for example, at least one of formation with a 3D printer, injection molding, powder compression molding, laser processing and cutting processing.

As in the example illustrated in FIG. 6, the unit structure 11 includes beam portions 12L and 12R, column portions 13UL, 13UR, 13DL and 13DR and a connection portion 14. Note that, the beam portion 12U in FIG. 6 is not included in the unit structure 11 in FIG. 6, but is included in another unit structure 11 adjacent to the unit structure 11 in FIG. 6 in the Y direction so that the beam portion 12U in FIG. 6 is depicted with a dashed line. Similarly, the beam portion 12D in FIG. 6 is not included in the unit structure 11 in FIG. 6, but is included in yet another unit structure 11 adjacent to the unit structure 11 in FIG. 6 in the Y direction so that the beam portion 12D in FIG. 6 is depicted with a dashed line. The size of the unit structure 11 is not particularly limited, but may be designed such that the XY cross section thereof is fitted in a square frame of 5 mm×5 mm to 80 mm×80 mm. Alternatively, the frame of this square with respect to the unit structure 11 can also be deformed, while the perimeter thereof is maintained, into a rectangular frame with a different aspect ratio.

The beam portions 12 are formed in a three-dimensional shape of at least one of a columnar body, a conical body, a polyhedron and a combination thereof, for example, in a cuboid shape, and are arranged along one of straight lines, one of curves, or at least one of the straight lines and the curves in the XY plane, for example, along the X direction. The size of the beam portions 12 in the longitudinal direction on the XY plane is not particularly limited, but may be designed in a range of, for example, 2 to 57 mm. The beam portion 12L includes a first surface facing the beam portion 12R. The beam portion 12R includes a second surface facing the first surface of the beam portion 12L.

The column portions 13 are formed in a three-dimensional shape of at least one of a columnar body, a conical body, a polyhedron and a combination thereof, for example, in a cuboid shape. The size of the column portions 13 in the longitudinal direction on the XY plane is not particularly limited, but may be designed in a range of, for example, 3 to 80 mm. The column portions 13UL and 13DL extend from one end and the other end of the first surface of the beam portion 12L toward the beam portions 12U and 12D, respectively, such that the distance between the column portions 13UL and 13DL decreases, and the column portions 13UL and 13DL are connected to the beam portions 12U and 12D, respectively. That is, the column portions 13UL and 13DL each form an acute angle ($\theta<90$ degrees) with respect to the first surface of the beam portion 12L on the XY plane.

The column portions 13UR and 13DR extend from one end and the other end of the second surface of the beam portion 12R toward the beam portions 12U and 12D, respectively, such that the distance between the column portions 13UR and 13DR decreases, and the column portions 13UR and 13DR are connected to the beam portions 12U and 12D, respectively. That is, the column portions 13UR and 13DR each form an acute angle with respect to the second surface of the beam portion 12R on the XY plane.

The connection portion 14 connects the beam portions 12U and 12D. Note that, in the example of FIG. 6, the connection portion 14 includes an annular columnar body obtained by connecting cuboids such that the cross section of the connection portion 14 becomes rhombic, but the present disclosure is not limited thereto. For example, the connection portion 14 may include an annular, circular, or elliptical columnar body obtained by connecting cuboids such that the cross section of the connection portion 14 becomes square, rectangular, or other polygonal. In the case of an annular columnar body obtained by connecting cuboids such that the XY cross section of the connection portion 14 becomes square, the size of the connection portion 14 is not particularly limited, but may be designed in a range of, for example, 2 mm×2 mm to 40 mm×40 mm. Alternatively, this square cross section of the connection portion 14 can also be deformed, while the perimeter thereof is maintained, into a rectangular cross section with a different aspect ratio.

The connection portion 14 is a member having rigidity against bending rotating around the Y-axis higher than rigidity against bending rotating around the X-axis. The connection portion 14 suppresses deformation of the unit structure 11 by torsion around the Y-axis.

The beam portions 12L and 12R are thicker than the column portions 13UL, 13DL, 13UR and 13DR and the connection portion 14. Here, the thickness of the beam portions 12 refers to, for example, the size thereof in a direction in which the beam portions 12L and 12R are arranged, for example, in the X direction, and the thickness of the column portions 13 refers to, for example, the size thereof in a direction orthogonal to the extension direction of the column portions 13 on the XY plane. The thickness of the connection portion 14 refers to, for example, the size of the XY cross section thereof in the circumferential direction. For this reason, in the column portions 13 and the connection portion 14, bending and twisting that are larger than those in the beam portions 12 are generated when a user is seated, and the column portions 13 and the connection portion 14 store a Z direction-component of an external force as elastic energy, and the beam portions 12 convey a force(s) from at least one of the column portions 13 and the connection portion 14 to at least one of the other column portions 13 and another connection portion 14.

(3-2) Backrest (3-2-1) Deformation of Backrest

Figure 7:
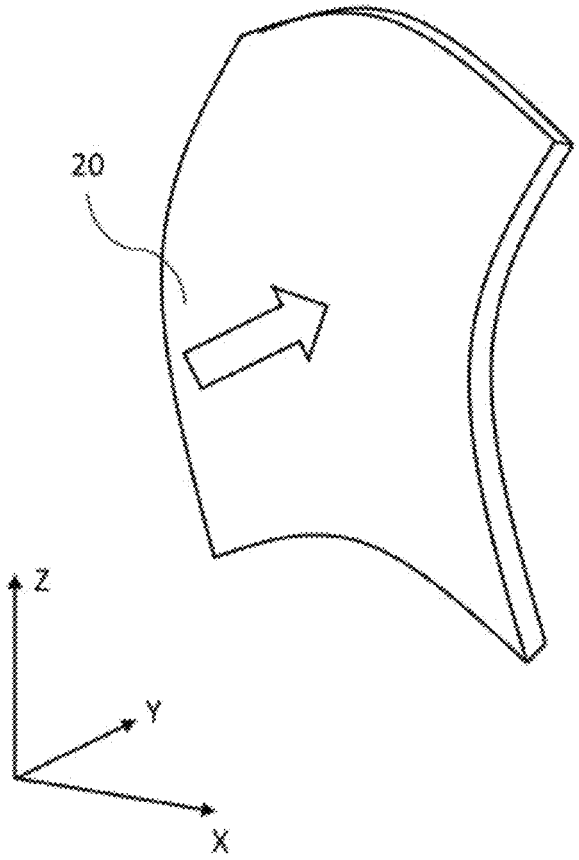
FIG. 7 is a diagram illustrating an exemplary three-dimensional shape of a backrest when the user leans on the backrest.
Figure 8:
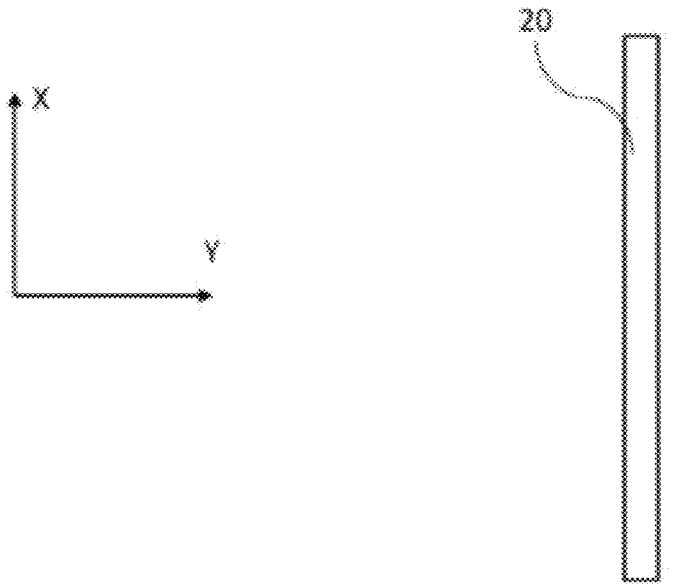
FIG. 8 is a diagram illustrating an exemplary XY cross-sectional shape of the backrest when the user does not lean on the backrest.
Figure 9:
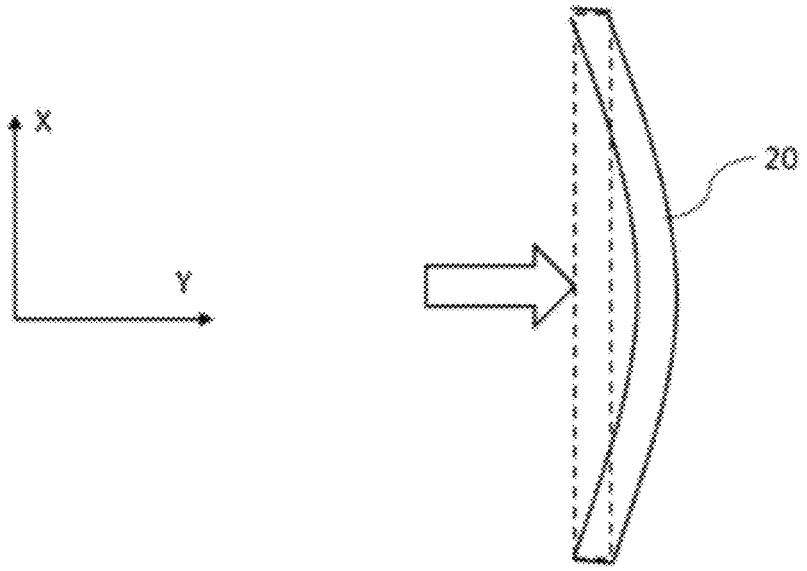
FIG. 9 is a diagram illustrating an exemplary XY cross-sectional shape of the backrest when the user leans on the backrest.
Figure 10:
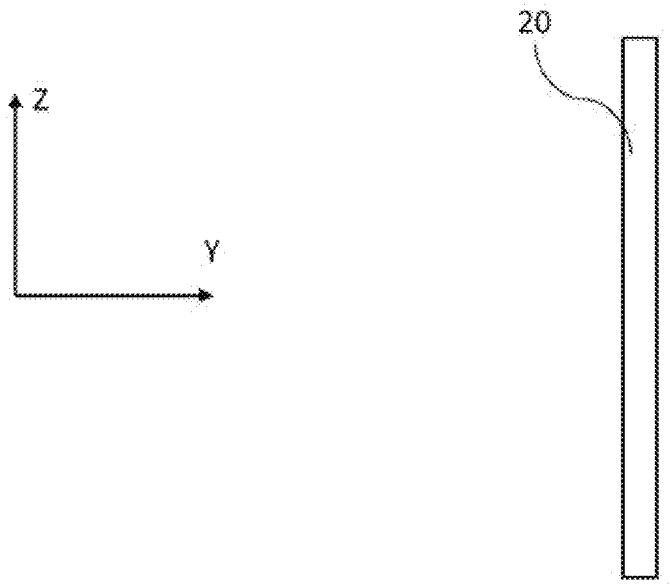
FIG. 10 is a diagram illustrating an exemplary YZ cross-sectional shape of the backrest when the user does not lean on the backrest.
Figure 11:
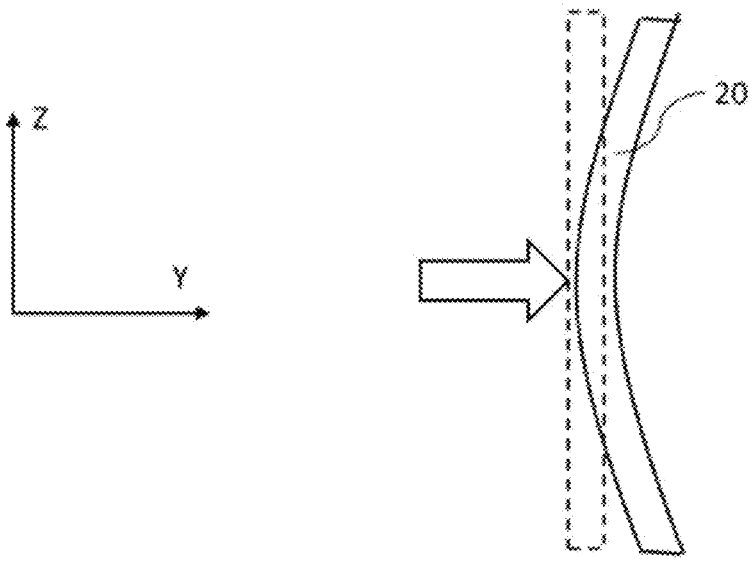
FIG. 11 is a diagram illustrating an exemplary YZ cross-sectional shape of the backrest when the user leans on the backrest.

The deformation of the backrest 20 will be described. FIG. 7 is a diagram illustrating an exemplary three-dimensional shape of the backrest when the user leans on the backrest. FIG. 8 is a diagram illustrating an exemplary XY cross-sectional shape of the backrest when the user does not lean on the backrest. FIG. 9 is a diagram illustrating an exemplary XY cross-sectional shape of the backrest when the user leans on the backrest. FIG. 10 is a diagram illustrating an exemplary YZ cross-sectional shape of the backrest when the user does not lean on the backrest. FIG. 11 is a diagram illustrating an exemplary YZ cross-sectional shape of the backrest when the user leans on the backrest.

As illustrated in FIGS. 7 to 11, the backrest 20 is deformed into a substantially saddle-type double-curved surface in response to an external force from a user when the user leans on the backrest 20.

The curvature of this double-curved surface depends on the magnitude (absolute value) of a normal direction-component (indicated by the arrows in FIGS. 7, 9 and 11) of the external force from the user when the user leans on the backrest 20, with respect to a reference surface of aback contact surface. In the examples of FIGS. 7 to 11, the reference surface of the back contact surface is the ZX plane so that the normal direction with respect to the reference surface is the Y direction. This double-curved surface is relative to a position that depends on mechanical properties of the structure of the backrest 20 irrespective of the position of the back of a user. In short, the backrest 20 is deformed into a saddle-type double-curved surface having a smaller negative value of Gaussian curvature as the Y direction-component of the external force from the user becomes larger. The saddle-type double-curved surface means a double-curved surface at every point on which the Gaussian curvature is negative.

As illustrated in FIGS. 8 and 9, when viewed on the XY plane, the back contact surface has the largest deformation (sinking) near the center and the deformation becomes smaller toward the periphery so that the back surface through the side surfaces of the user is supported by the back contact surface along the spine of the user. As illustrated in FIGS. 10 and 11, when viewed on the YZ plane, the back contact surface has the largest deformation (sinking) near the end portions of the back contact surface and the deformation becomes smaller toward the center thereof so that the back surface of the user is supported by the back contact surface along the S-curve of the spine of the user. The backrest 20 as such, which causes the back contact surface to look flat or look like any other arbitrary surface shape when the user does not lean on the backrest 20, makes it possible to produce a comfortable sitting feeling, in particular a fitting feeling to the back of the user, by enveloping (at least a portion of) the back when the user leans on the backrest 20.

The target curved surface formed by the back contact surface may include a plurality of curved surfaces relative to different positions. For example, the back contact surface may form a target curved surface including: a substantially saddle-type first double-curved surface that envelops at least a portion of the lower side of the back; and a substantially saddle-type second double-curved surface that envelops at least a portion of the upper side of the back. The target curved surface may include not only a saddle-type double-curved surface(s) but also a bowl-type double-curved surface(s) or any other-type double-curved surface(s). The target curved surface means a curved surface including at least one double-curved surface and may further include a developable surface(s) in addition to a double-curved surface(s). That is, in the target curved surface, positive, negative, or zero Gaussian curvatures may be mixed.

(3-2-2) Structure of Backrest

Figure 12:
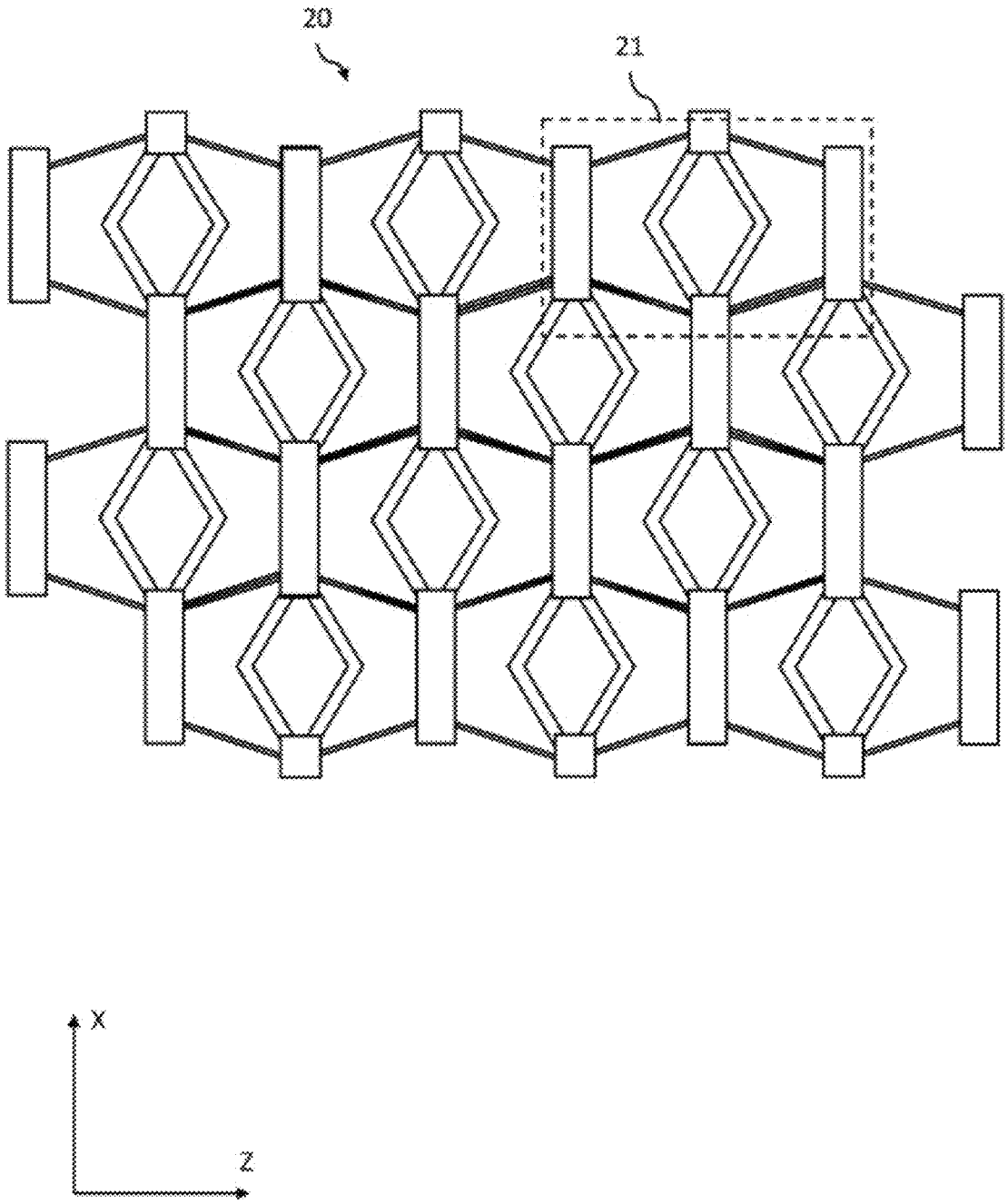
FIG. 12 is a diagram illustrating an exemplary structure included in the backrest.
Figure 13:
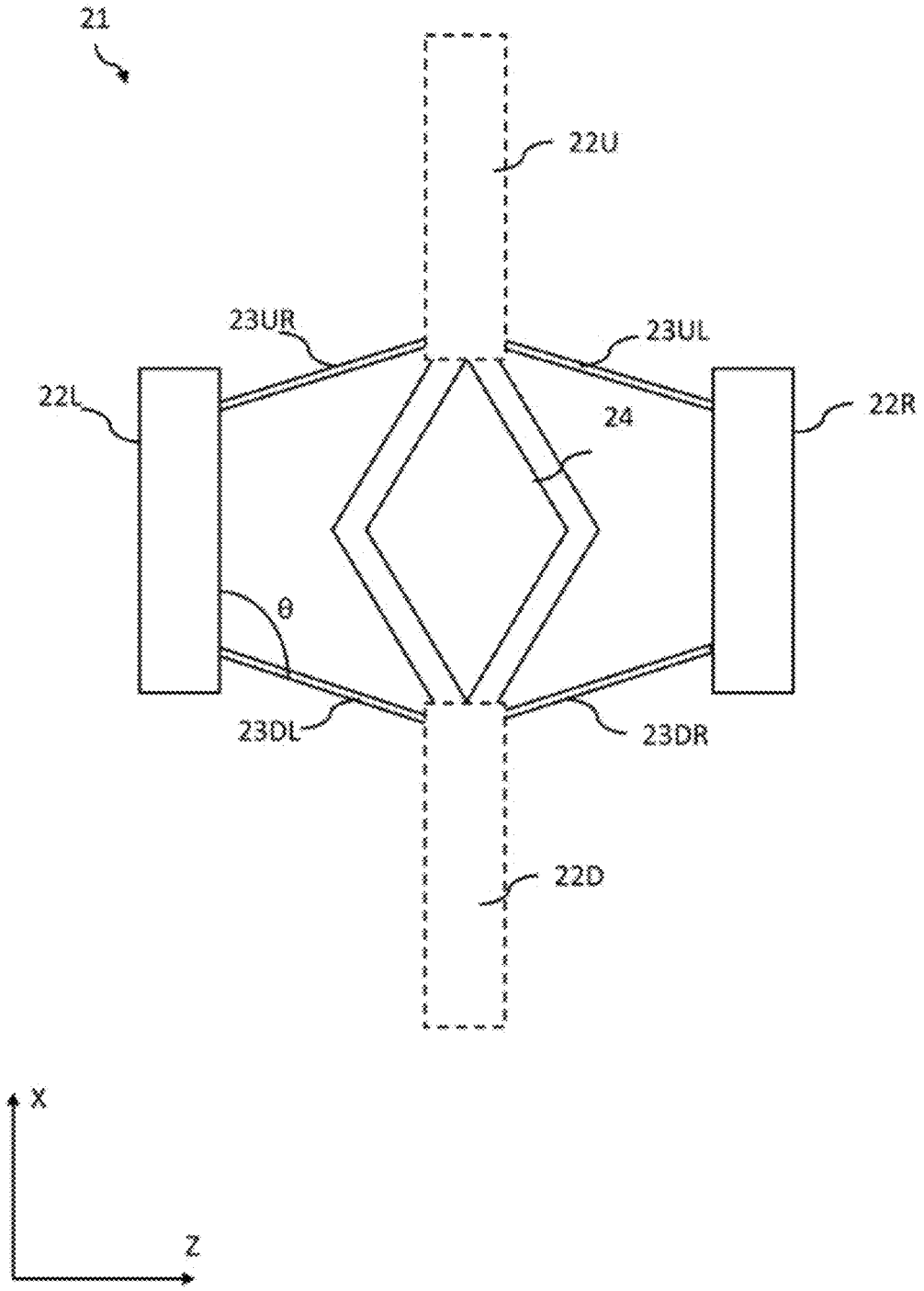
FIG. 13 is a diagram illustrating an exemplary unit structure that constitutes the structure included in the backrest.

The structure included in the backrest 20 will be described. This structure realizes the deformation described in (3-2-1) above. FIG. 12 is a diagram illustrating an exemplary structure included in the backrest. FIG. 13 is a diagram illustrating an exemplary unit structure that constitutes the structure included in the backrest.

The structure in FIG. 12 is obtained by continuously arranging unit structures 21, one of which is illustrated in FIG. 13, along a reference surface of the back contact surface of the backrest 20, which is the ZX plane in this example. Note that, it may also be configured such that structures are arranged in a portion (for example, the central portion) of the backrest 20 and are not arranged in the remaining portion (for example, the end portions) of the backrest 20. In the same manner as in the structure of the seat portion 10, this structure can realize human-intended mechanical properties (that is, the deformation described in (3-2-1) above) by a repetitive structure of unit structures. Note that, the repetitive structure of unit structures may be produced by utilizing, for example, at least one of formation with a 3D printer, injection molding, powder compression molding, laser processing and cutting processing.

As in the example illustrated in FIG. 13, the unit structure 21 includes beam portions 22L and 22R, column portions 23UL, 23UR, 23DL and 23DR and a connection portion 24. Note that, the beam portion 22U in FIG. 13 is not included in the unit structure 21 in FIG. 13, but is included in another unit structure 21 adjacent to the unit structure 21 in FIG. 13 in the Y direction so that the beam portion 22U in FIG. 13 is depicted with a dashed line. Similarly, the beam portion 22D in FIG. 13 is not included in the unit structure 21 in FIG. 13, but is included in yet another unit structure 21 adjacent to the unit structure 21 in FIG. 13 in the Y direction so that the beam portion 22D in FIG. 13 is depicted with a dashed line. The size of the unit structure 21 is not particularly limited, but may be designed such that the ZX cross section thereof is fitted in a square frame of 5 mm×5 mm to 80 mm×80 mm. Alternatively, the frame of this square with respect to the unit structure 21 can also be deformed, while the perimeter thereof is maintained, into a rectangular frame with a different aspect ratio.

The beam portions 22 are formed in a three-dimensional shape of at least one of a columnar body, a conical body, a polyhedron and a combination thereof, for example, in a cuboid shape, and are arranged along one of straight lines, one of curves, or at least one of the straight lines and the curves in the ZX plane, for example, along the Z direction. The size of the beam portions 22 in the longitudinal direction on the ZX plane is not particularly limited, but may be designed in a range of, for example, 2 to 57 mm. The beam portion 22L includes a first surface facing the beam portion 22R. The beam portion 22R includes a second surface facing the first surface of the beam portion 22L.

The column portions 23 are formed in a three-dimensional shape of at least one of a columnar body, a conical body, a polyhedron and a combination thereof, for example, in a cuboid shape. The size of the column portions 23 in the longitudinal direction on the ZX plane is not particularly limited, but may be designed in a range of, for example, 3 to 80 mm. The column portions 23UL and 23DL extend from one end and the other end of the first surface of the beam portion 22L toward the beam portions 22U and 22D, respectively, such that the distance between the column portions 23UL and 23DL increases, and the column portions 23UL and 23DL are connected to the beam portions 22U and 22D, respectively. That is, the column portions 23UL and 23DL each form an obtuse angle ($\theta$>90 degrees) with respect to the first surface of the beam portion 22L on the ZX plane.

The column portions 23UR and 23DR extend from one end and the other end of the second surface of the beam portion 22R toward the beam portions 22U and 22D, respectively, such that the distance between the column portions 23UR and 23DR increases, and the column portions 23UR and 23DR are connected to the beam portions 22U and 22D, respectively. That is, the column portions 23UR and 23DR each form an obtuse angle with respect to the second surface of the beam portion 22R on the ZX plane.

The connection portion 24 connects the beam portions 22U and 22D. Note that, in the example of FIG. 13, the connection portion 24 includes an annular columnar body obtained by connecting cuboids such that the cross section of the connection portion 24 becomes rhombic, but the present disclosure is not limited thereto. For example, the connection portion 24 may include an annular, circular, or elliptical columnar body obtained by connecting cuboids such that the cross section of the connection portion 24 becomes square, rectangular, or other polygonal. In the case of an annular columnar body obtained by connecting cuboids such that the ZX cross section of the connection portion 24 becomes square, the size of the connection portion 24 is not particularly limited, but may be designed in a range of, for example, 2 mm×2 mm to 40 mm×40 mm. Alternatively, this square cross section of the connection portion 24 can also be deformed, while the perimeter thereof is maintained, into a rectangular cross section with a different aspect ratio.

The connection portion 24 is a member having rigidity against bending rotating around the X-axis higher than rigidity against bending rotating around the Z-axis. The connection portion 24 suppresses deformation of the unit structure 21 by torsion around the X-axis.

The beam portions 22L and 22R are thicker than the column portions 23UL, 23DL, 23UR and 23DR and the connection portion 24. Here, the thickness of the beam portions 22 refers to, for example, the size thereof in a direction in which the beam portions 22L and 22R are arranged, for example, in the Z direction, and the thickness of the column portions 23 refers to, for example, the size thereof in a direction orthogonal to the extension direction of the column portions 23 on the ZX plane. The thickness of the connection portion 14 refers to, for example, the size of the ZX cross section thereof in the circumferential direction. For this reason, in the column portions 23 and the connection portion 24, bending and twisting that are larger than those in the beam portions 22 are generated when a user leans on the backrest 20, and the column portions 23 and the connection portion 24 store a Y direction-component of an external force as elastic energy, and the beam portions 22 convey a tension(s) from at least one of the column portions 23 and the connection portion 24 to at least one of the other column portions 23 and another connection portion 24.

(4) Summation

As described above, the seat portion of the chair according to the present embodiment is elastically deformed by an external force received by the seat portion when the buttocks of a user being seated come into contact with the seat portion such that a seating surface having a double-curved surface shape, which itself envelops at least a portion of the buttocks, is formed. Further, the backrest of this chair is elastically deformed by an external force received by the backrest when the back of a user comes into contact with the backrest when the user leans on the backrest such that a back contact surface having a double-curved surface shape, which itself envelops at least a portion of the back, is formed. For this reason, since the seat portion and the backrest themselves are elastically deformed so as to fit the human body, this chair is neither required to force the seat portion or the backrest to have a specific shape nor required to add a certain mechanical mechanism in order to improve a sitting feeling. That is, according to the present embodiment, it is possible to provide a chair with a high degree of freedom in design and a comfortable sitting feeling.

(5) Variations (5-1) Variation 1

In the above-described embodiment, a chair has been described which includes: a seat portion that is deformed in response to an external force from a user such that a double-curved surface of a prescribed type, relative to a prescribed position, is formed by a seating surface irrespective of a position of buttocks of the user when the user is seated; and a backrest that is deformed in response to the external force from the user such that a double-curved surface of a first type, relative to a first position, is formed by a back contact surface irrespective of a position of a back of the user when the user leans on the backrest.

However, it is possible to provide a chair with a high degree of freedom in design and a comfortable sitting feeling even when the seat portion is replaced with an existing seat portion or the backrest is replaced with an existing backrest. Further, even in the case of a chair with no backrest, such as a counter stool, it is possible to provide a chair with a high degree of freedom in design and a comfortable sitting feeling by the chair including the seat portion described in the embodiment.

(5-2) Variation 2

The seat portion and the backrest described in the above embodiment may become parts of a chair and may also become independent products. For example, it is possible to improve the sitting feeling of an existing chair by using, instead of an existing cushion, the seat portion as such and the backrest as such together with the existing chair.

The above-described embodiment merely illustrates examples for assistance of understandings of the concept of the present invention and is not intended to limit the scope of the present invention. Addition, deletion, or replacement of various components can be made in the embodiment without deviating from the spirit of the present invention.

(5-3) Variation 3

Figure 14:
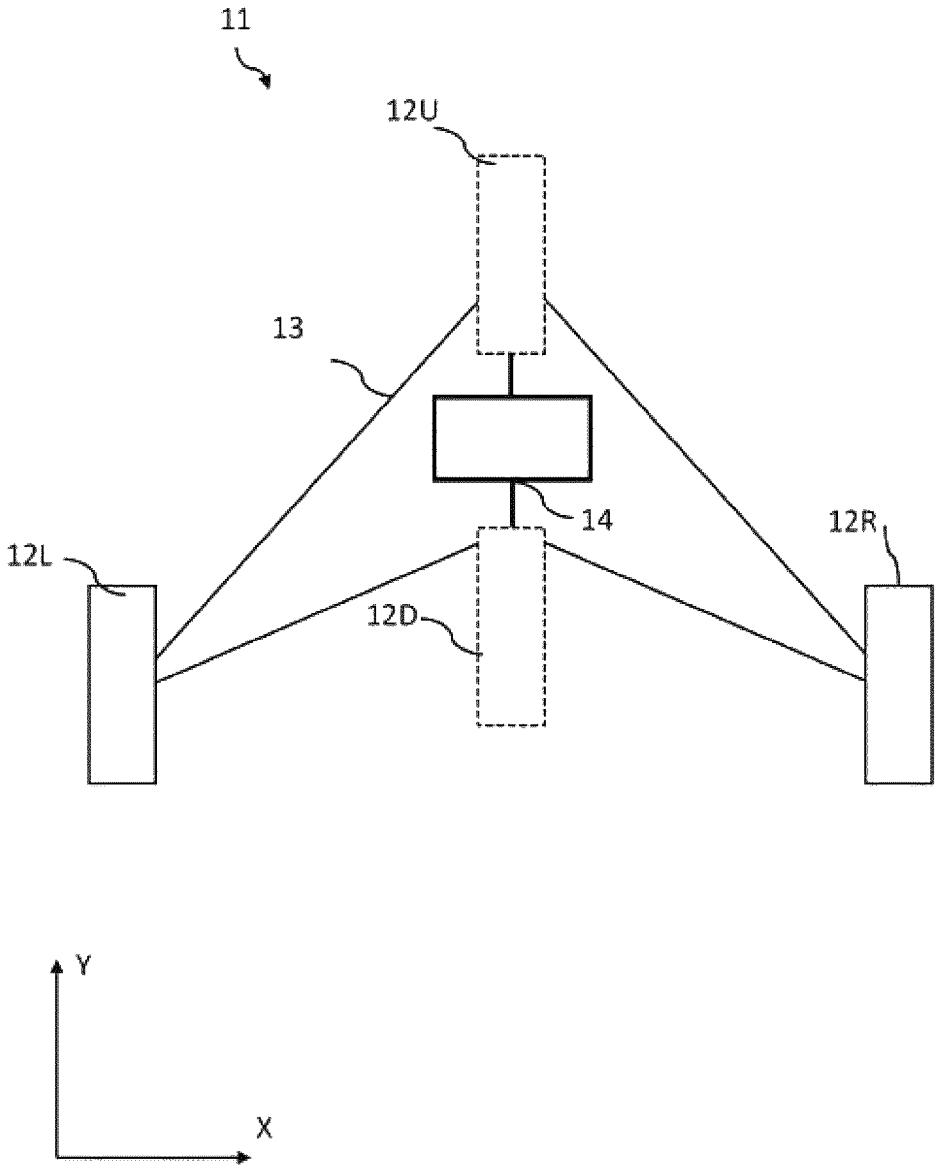
FIG. 14 is a diagram illustrating an exemplary unit structure that constitutes the structure included in the seat portion.
Figure 15:
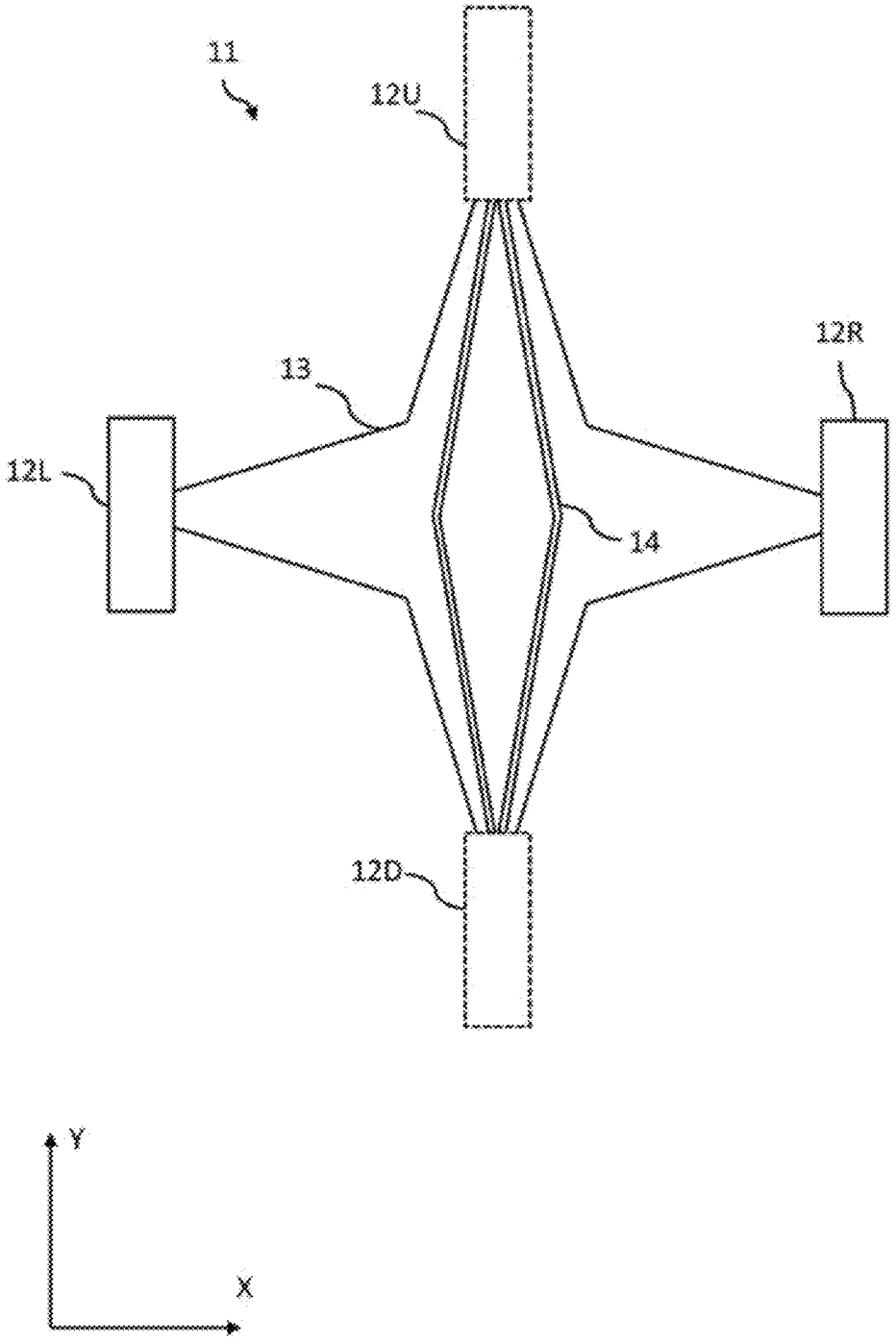
FIG. 15 is a diagram illustrating an exemplary unit structure that constitutes the structure included in the seat portion.
Figure 16:
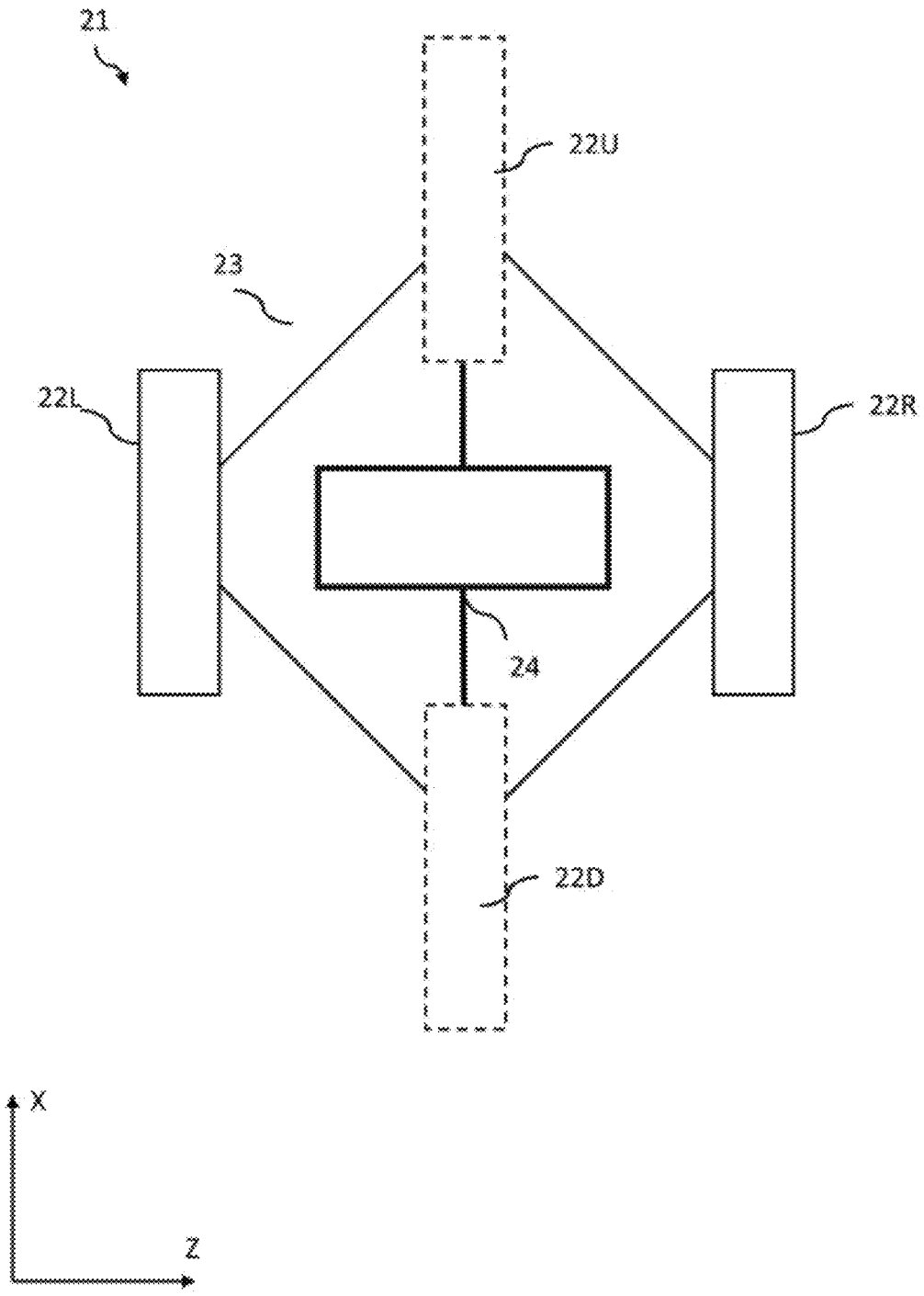
FIG. 16 is a diagram illustrating an exemplary unit structure that constitutes the structure included in the backrest.
Figure 17:
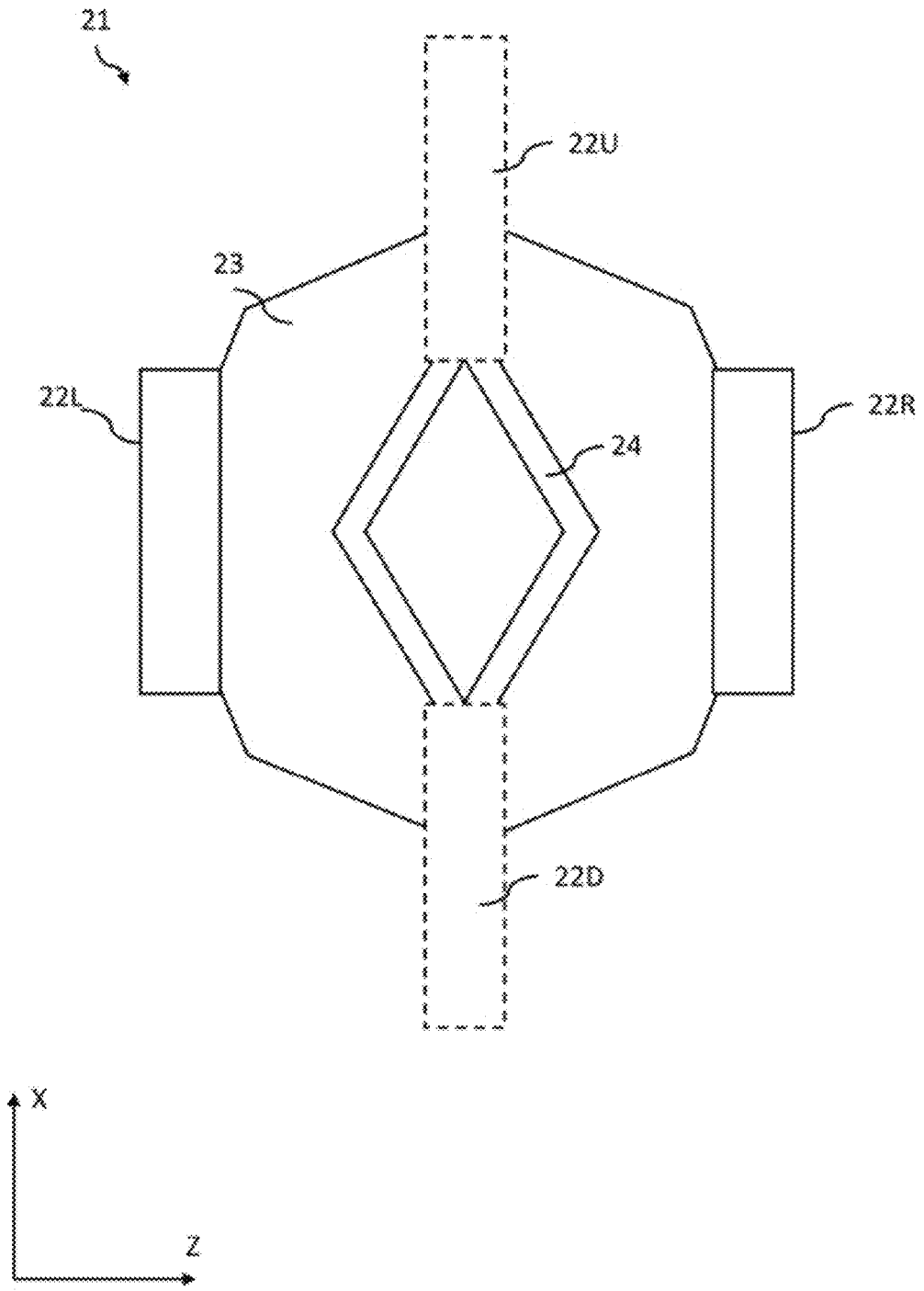
FIG. 17 is a diagram illustrating an exemplary unit structure that constitutes the structure included in the backrest.

FIG. 14 is a diagram illustrating an exemplary unit structure that constitutes the structure included in the seat portion. FIG. 15 is a diagram illustrating an exemplary unit structure that constitutes the structure included in the seat portion. FIG. 16 is a diagram illustrating an exemplary unit structure that constitutes the structure included in the backrest. FIG. 17 is a diagram illustrating an exemplary unit structure that constitutes the structure included in the backrest.

Although the specific examples of the unit structures have been described in the above embodiment, the unit structures capable of constituting the structure of the seat portion or the backrest are not limited to the examples in FIGS. 6 and 13.

Specifically, the unit structure 11 may be modified to the unit structure 11 illustrated in the example of FIG. 14 or 15. Further, the unit structure 21 may be modified to the unit structure 11 illustrated in FIG. 16 or 17.

For example, the unit structure 11 can be generalized and expressed as a structure which includes: beam portions 12L and 12R disposed substantially parallel to a main axis (for example, a Y direction) on a reference surface of a seating surface, where the beam portions 12L and 12R pass through, among four or more vertices included in a polygon having four or more even numbers of sides, a first vertex and a second vertex that are opposite to each other; a connection portion 14 connecting beam portions of other two unit structures 11 adjacent to the unit structure 11 at, among said vertices, a third vertex and a fourth vertex that are opposite to each other; and column portions 13 extending from the beam portions 12L and 12R along the sides of the polygon, and in which Poisson's ratio when the unit structure 11 is pulled and deformed in a direction of the main axis is negative, or the like. In the examples of FIGS. 6, 14 and 15, the number of vertices of the polygon as such is 6, 4 and 8, respectively.

For example, the unit structure 21 can be generalized and expressed as a structure which includes: beam portions 22L and 22R disposed substantially parallel to a main axis (for example, an X direction) on a reference surface of a back contact surface, where the beam portions 22L and 22R pass through, among four or more vertices included in a polygon having four or more even numbers of sides, a first vertex and a second vertex that are opposite to each other; a connection portion 24 connecting beam portions of other two unit structures 21 adjacent to the unit structure 21 at, among said vertices, a third vertex and a fourth vertex that are opposite to each other; and column portions 23 extending from the beam portions 22L and 22R along the sides of the polygon, and in which Poisson's ratio when the unit structure 21 is pulled and deformed in a direction of the main axis is positive, or the like. In the examples of FIGS. 13, 16 and 17, the number of vertices of the polygon as such is 6, 4 and 8, respectively.

(6) Appendices

The matters described in the embodiment will be described below as appendices.

(Appendix 1)

A chair, including a seat portion (10) in which a deformation mode of at least a portion of a seating surface is isolated such that a target curved surface including a double-curved surface of a prescribed type, relative to a prescribed position, is formed irrespective of a position of buttocks of a user when the user is seated.

(Appendix 2)

The chair according to (appendix 1), in which curvature of the double-curved surface depends on magnitude of a normal direction-component of an external force from the user, with respect to a reference surface of the seating surface.

(Appendix 3)

The chair according to (appendix 2), in which the double-curved surface is a bowl-type double-curved surface having a larger positive value of Gaussian curvature as the normal direction-component of the external force from the user, with respect to the reference surface of the seating surface, becomes larger.

(Appendix 4)

The chair according to (appendix 3), in which:

the seat portion includes a plurality of unit structures (11) continuously arranged along the reference surface of the seating surface, a first unit structure that is one of the plurality of unit structures includes:

a first beam portion (12L) arranged substantially parallel to a main axis on the reference surface of the seating surface, where the first beam portion passes through a first vertex among four or more vertices included in a polygon having four or more even numbers of sides;

a second beam portion (12R) arranged substantially parallel to the main axis, where the second beam portion passes through a second vertex among the four or more vertices and the second vertex is opposite to the first vertex;

a connection portion (14) connecting beam portions (12U and 12D) of a second unit structure and a third unit structure at a third vertex and a fourth vertex among the four or more vertices, where the second unit structure and the third unit structure are adjacent to the first unit structure and the third vertex and the fourth vertex are opposite to each other; and column portions (13UL, 13UR, 13DL and 13DR) extending from the first beam portion and the second beam portion along the sides of the polygon, and Poisson's ratio when the first unit structure is pulled and deformed in a direction of the main axis is negative.

(Appendix 5)

The chair according to (appendix 3), in which:

the seat portion includes a plurality of unit structures (11) continuously arranged along the reference surface of the seating surface, at least one of the unit structures includes:

a first beam portion (12L) including a first surface;

a second beam portion (12R) including a second surface, where the second surface is opposite to the first surface;

a first column portion (13UL) and a second column portion (13DL) that extend from one end and the other end of the first surface toward the second surface, respectively, such that a distance between the first column portion and the second column portion decreases;

a third column portion (13UR) and a fourth column portion (13DR) that extend from one end and the other end of the second surface toward the first surface, respectively, such that a distance between the third column portion and the fourth column portion decreases; and a connection portion (14) connecting end portions of the first column portion and the second column portion and end portions of the third column portion and the fourth column portion, where the end portions of the first column portion and the second column portion are not in contact with the first surface and the end portions of the third column portion and the fourth column portion are not in contact with the second surface, and the first beam portion and the second beam portion are thicker than the first column portion, the second column portion, the third column portion, and the fourth column portion.

(Appendix 6)

A chair, including:

a seat portion (10); and a backrest (20) in which a deformation mode of at least a portion of a back contact surface is isolated such that a first target curved surface including a double-curved surface of a first type, relative to a first position, is formed irrespective of a position of a back of a user when the user leans on the backrest.

(Appendix 7)

The chair according to (appendix 6), in which curvature of the double-curved surface depends on magnitude of a normal direction-component of an external force from the user, with respect to a reference surface of the back contact surface.

(Appendix 8)

The chair according to (appendix 7), in which the double-curved surface is a saddle-type double-curved surface having a smaller negative value of Gaussian curvature as the normal direction-component of the external force from the user, with respect to the reference surface of the back contact surface, becomes larger.

(Appendix 9)

The chair according to (appendix 8), in which:

the backrest includes a plurality of unit structures (21) continuously arranged along the reference surface of the back contact surface, a first unit structure that is one of the plurality of unit structures includes:

a first beam portion (22L) arranged substantially parallel to a main axis on the reference surface of the back contact surface, where the first beam portion passes through a first vertex among four or more vertices included in a polygon having four or more even numbers of sides;

a second beam portion (22R) arranged substantially parallel to the main axis, where the second beam portion passes through a second vertex among the four or more vertices and the second vertex is opposite to the first vertex;

a connection portion (24) connecting beam portions (22U and 22D) of a second unit structure and a third unit structure at a third vertex and a fourth vertex among the four or more vertices, where the second unit structure and the third unit structure are adjacent to the first unit structure and the third vertex and the fourth vertex are opposite to each other; and column portions (23UL, 23UR, 23DL and 23DR) extending from the first beam portion and the second beam portion along the sides of the polygon, and Poisson's ratio when the first unit structure is pulled and deformed in a direction of the main axis is positive.

(Appendix 10)

The chair according to (appendix 8), in which:

the backrest includes a plurality of unit structures (21) continuously arranged along the reference surface of the back contact surface, at least one of the unit structures includes:

a first beam portion (22L) including a first surface;

a second beam portion (22R) including a second surface, where the second surface is opposite to the first surface;

a first column portion (23UL) and a second column portion (23DL) that extend from one end and the other end of the first surface toward the second surface, respectively, such that a distance between the first column portion and the second column portion increases;

a third column portion (23UR) and a fourth column portion (23DR) that extend from one end and the other end of the second surface toward the first surface, respectively, such that a distance between the third column portion and the fourth column portion increases; and a connection portion (24) connecting end portions of the first column portion and the second column portion and end portions of the third column portion and the fourth column portion, where the end portions of the first column portion and the second column portion are not in contact with the first surface and the end portions of the third column portion and the fourth column portion are not in contact with the second surface, and the first beam portion and the second beam portion are thicker than the first column portion, the second column portion, the third column portion, and the fourth column portion.

(Appendix 11)

The chair according to any of (appendix 6) to (appendix 10), in which a deformation mode of at least a portion of a seating surface of the seat portion is isolated such that a second target curved surface including a double-curved surface of a second type, relative to a second position, is formed irrespective of a position of buttocks of the user when the user is seated.

(Appendix 12)

A seat portion (10), in which a deformation mode of at least a portion of a seating surface is isolated such that a target curved surface including a double-curved surface of a prescribed type, relative to a prescribed position, is formed irrespective of a position of buttocks of a user when the user is seated.

(Appendix 13)

A backrest (20), in which a deformation mode of at least a portion of a back contact surface is isolated such that a target curved surface including a double-curved surface of a prescribed type, relative to a prescribed position, is formed irrespective of a position of a back of a user when the user leans on the backrest.

The disclosure of Japanese Patent Application No. 2020-001891, filed on Jan. 9, 2020, including the specification, drawings and abstract, is incorporated herein by reference in its entirety.

REFERENCE SIGNS LIST

1: Chair
10: Seat portion
11: Unit structure
12: Beam portion
13: Column portion

14: Connection portion
20: Backrest
21: Unit structure
22: Beam portion
23: Column portion
24: Connection portion
30: Leg

The invention claimed is:

1. A chair, comprising a seat portion in which a deformation mode of at least a portion of a seating surface is isolated such that a target curved surface including a double-curved surface of a prescribed type, relative to a prescribed position, is formed irrespective of a position of buttocks of a user when the user is seated, wherein curvature of the double-curved surface depends on magnitude of a normal direction-component of an external force from the user, with respect to a reference surface of the seating surface, the double-curved surface is a bowl-type double-curved surface having a larger positive value of Gaussian curvature as the normal direction-component of the external force from the user, with respect to the reference surface of the seating surface, becomes larger, the seat portion includes a plurality of unit structures continuously arranged along the reference surface of the seating surface, a first unit structure that is one of the plurality of unit structures includes:

a first beam portion arranged substantially parallel to a main axis on the reference surface of the seating surface, the first beam portion passing through a first vertex among four or more vertices included in a polygon having four or more even numbers of sides;

a second beam portion arranged substantially parallel to the main axis, the second beam portion passing through a second vertex among the four or more vertices, the second vertex being opposite to the first vertex;

a connection portion connecting beam portions of a second unit structure and a third unit structure at a third vertex and a fourth vertex among the four or more vertices, the second unit structure and the third unit structure being adjacent to the first unit structure, the third vertex and the fourth vertex being opposite to each other; and column portions extending from the first beam portion and the second beam portion along the sides of the polygon, and Poisson's ratio when the first unit structure is pulled and deformed in a direction of the main axis is negative.

2. A chair, comprising a seat portion in which a deformation mode of at least a portion of a seating surface is isolated such that a target curved surface including a double-curved surface of a prescribed type, relative to a prescribed position, is formed irrespective of a position of buttocks of a user when the user is seated, wherein curvature of the double-curved surface depends on magnitude of a normal direction-component of an external force from the user, with respect to a reference surface of the seating surface, the double-curved surface is a bowl-type double-curved surface having a larger positive value of Gaussian curvature as the normal direction-component of the external force from the user, with respect to the reference surface of the seating surface, becomes larger, the seat portion includes a plurality of unit structures continuously arranged along the reference surface of the seating surface, at least one of the unit structures includes:

a first beam portion including a first surface;

a second beam portion including a second surface, the second surface being opposite to the first surface;

first and second column portions extending from one end and the other end of the first surface toward the second surface, respectively, such that a distance between the first and second column portions decreases;

third and fourth column portions extending from one end and the other end of the second surface toward the first surface, respectively, such that a distance between the third and fourth column portions decreases; and a connection portion connecting end portions of the first and second column portions and end portions of the third and fourth column portions, the end portions of the first and second column portions not being in contact with the first surface, the end portions of the third and fourth column portions not being in contact with the second surface, and the first beam portion and the second beam portion are thicker than the first column portion, the second column portion, the third column portion and the fourth column portion.

3. A chair, comprising:

a seat portion; and a backrest in which a deformation mode of at least a portion of a back contact surface is isolated such that a first target curved surface including a double-curved surface of a first type, relative to a first position, is formed irrespective of a position of a back of a user when the user leans on the backrest, wherein curvature of the double-curved surface depends on magnitude of a normal direction-component of an external force from the user, with respect to a reference surface of the back contact surface, the double-curved surface is a saddle-type double-curved surface having a smaller negative value of Gaussian curvature as the normal direction-component of the external force from the user, with respect to the reference surface of the back contact surface, becomes larger, the backrest includes a plurality of unit structures continuously arranged along the reference surface of the back contact surface, a first unit structure that is one of the plurality of unit structures includes:

a first beam portion arranged substantially parallel to a main axis on the reference surface of the back contact surface, the first beam portion passing through a first vertex among four or more vertices included in a polygon having four or more even numbers of sides;

a second beam portion arranged substantially parallel to the main axis, the second beam portion passing through a second vertex among the four or more vertices, the second vertex being opposite to the first vertex;

a connection portion connecting beam portions of a second unit structure and a third unit structure at a third vertex and a fourth vertex among the four or more vertices, the second unit structure and the third unit structure being adjacent to the first unit structure, the third vertex and the fourth vertex being opposite to each other; and column portions extending from the first beam portion and the second beam portion along the sides of the polygon, and Poisson's ratio when the first unit structure is pulled and deformed in a direction of the main axis is positive.

4. The chair according to claim 3, wherein a deformation mode of at least a portion of a seating surface of the seat portion is isolated such that a second target curved surface including a double-curved surface of a second type, relative to a second position, is formed irrespective of a position of buttocks of the user when the user is seated.

5. A chair, comprising:

a seat portion; and a backrest in which a deformation mode of at least a portion of a back contact surface is isolated such that a first target curved surface including a double-curved surface of a first type, relative to a first position, is formed irrespective of a position of a back of a user when the user leans on the backrest, wherein curvature of the double-curved surface depends on magnitude of a normal direction-component of an external force from the user, with respect to a reference surface of the back contact surface, the double-curved surface is a saddle-type double-curved surface having a smaller negative value of Gaussian curvature as the normal direction-component of the external force from the user, with respect to the reference surface of the back contact surface, becomes larger, the backrest includes a plurality of unit structures continuously arranged along the reference surface of the back contact surface, at least one of the unit structures includes:

a first beam portion including a first surface;

a second beam portion including a second surface, the second surface being opposite to the first surface;

first and second column portions extending from one end and the other end of the first surface toward the second surface, respectively, such that a distance between the first and second column portions increases;

third and fourth column portions extending from one end and the other end of the second surface toward the first surface, respectively, such that a distance between the third and fourth column portions increases; and a connection portion connecting end portions of the first and second column portions and end portions of the third and fourth column portions, the end portions of the first and second column portions not being in contact with the first surface, the end portions of the third and fourth column portions not being in contact with the second surface, and the first beam portion and the second beam portion are thicker than the first column portion, the second column portion, the third column portion and the fourth column portion.

6. The chair according to claim 5, wherein a deformation mode of at least a portion of a seating surface of the seat portion is isolated such that a second target curved surface including a double-curved surface of a second type, relative to a second position, is formed irrespective of a position of buttocks of the user when the user is seated.

7. A seat portion in which a deformation mode of at least a portion of a seating surface is isolated such that a target curved surface including a double-curved surface of a prescribed type, relative to a prescribed position, is formed irrespective of a position of buttocks of a user when the user is seated, wherein curvature of the double-curved surface depends on magnitude of a normal direction-component of an external force from the user, with respect to a reference surface of the seating surface, the double-curved surface is a bowl-type double-curved surface having a larger positive value of Gaussian curvature as the normal direction-component of the external force from the user, with respect to the reference surface of the seating surface, becomes larger, the seat portion includes a plurality of unit structures continuously arranged along the reference surface of the seating surface, a first unit structure that is one of the plurality of unit structures includes:

a first beam portion arranged substantially parallel to a main axis on the reference surface of the seating surface, the first beam portion passing through a first vertex among four or more vertices included in a polygon having four or more even numbers of sides;

a second beam portion arranged substantially parallel to the main axis, the second beam portion passing through a second vertex among the four or more vertices, the second vertex being opposite to the first vertex;

a connection portion connecting beam portions of a second unit structure and a third unit structure at a third vertex and a fourth vertex among the four or more vertices, the second unit structure and the third unit structure being adjacent to the first unit structure, the third vertex and the fourth vertex being opposite to each other; and column portions extending from the first beam portion and the second beam portion along the sides of the polygon, and Poisson's ratio when the first unit structure is pulled and deformed in a direction of the main axis is negative.

8. A backrest in which a deformation mode of at least a portion of a back contact surface is isolated such that a target curved surface including a double-curved surface of a prescribed type, relative to a prescribed position, is formed irrespective of a position of a back of a user when the user leans on the backrest, wherein curvature of the double-curved surface depends on magnitude of a normal direction-component of an external force from the user, with respect to a reference surface of the back contact surface, the double-curved surface is a saddle-type double-curved surface having a smaller negative value of Gaussian curvature as the normal direction-component of the external force from the user, with respect to the reference surface of the back contact surface, becomes larger, the backrest includes a plurality of unit structures continuously arranged along the reference surface of the back contact surface, a first unit structure that is one of the plurality of unit structures includes:

a first beam portion arranged substantially parallel to a main axis on the reference surface of the back contact surface, the first beam portion passing through a first vertex among four or more vertices included in a polygon having four or more even numbers of sides;

a second beam portion arranged substantially parallel to the main axis, the second beam portion passing through a second vertex among the four or more vertices, the second vertex being opposite to the first vertex;

a connection portion connecting beam portions of a second unit structure and a third unit structure at a third vertex and a fourth vertex among the four or more vertices, the second unit structure and the third unit structure being adjacent to the first unit structure, the third vertex and the fourth vertex being opposite to each other; and column portions extending from the first beam portion and the second beam portion along the sides of the polygon, and Poisson's ratio when the first unit structure is pulled and deformed in a direction of the main axis is positive.

9. A seat portion in which a deformation mode of at least a portion of a seating surface is isolated such that a target curved surface including a double-curved surface of a prescribed type, relative to a prescribed position, is formed irrespective of a position of buttocks of a user when the user is seated, wherein curvature of the double-curved surface depends on magnitude of a normal direction-component of an external force from the user, with respect to a reference surface of the seating surface, the double-curved surface is a bowl-type double-curved surface having a larger positive value of Gaussian curvature as the normal direction-component of the external force from the user, with respect to the reference surface of the seating surface, becomes larger, the seat portion includes a plurality of unit structures continuously arranged along the reference surface of the seating surface, at least one of the unit structures includes:

a first beam portion including a first surface;

a second beam portion including a second surface, the second surface being opposite to the first surface;

first and second column portions extending from one end and the other end of the first surface toward the second surface, respectively, such that a distance between the first and second column portions decreases;

third and fourth column portions extending from one end and the other end of the second surface toward the first surface, respectively, such that a distance between the third and fourth column portions decreases; and a connection portion connecting end portions of the first and second column portions and end portions of the third and fourth column portions, the end portions of the first and second column portions not being in contact with the first surface, the end portions of the third and fourth column portions not being in contact with the second surface, and the first beam portion and the second beam portion are thicker than the first column portion, the second column portion, the third column portion and the fourth column portion.

10. A backrest in which a deformation mode of at least a portion of a back contact surface is isolated such that a first target curved surface including a double-curved surface of a first type, relative to a first position, is formed irrespective of a position of a back of a user when the user leans on the backrest, wherein curvature of the double-curved surface depends on magnitude of a normal direction-component of an external force from the user, with respect to a reference surface of the back contact surface, the double-curved surface is a saddle-type double-curved surface having a smaller negative value of Gaussian curvature as the normal direction-component of the external force from the user, with respect to the reference surface of the back contact surface, becomes larger, the backrest includes a plurality of unit structures continuously arranged along the reference surface of the back contact surface, at least one of the unit structures includes:

a first beam portion including a first surface;

a second beam portion including a second surface, the second surface being opposite to the first surface;

first and second column portions extending from one end and the other end of the first surface toward the second surface, respectively, such that a distance between the first and second column portions increases;

third and fourth column portions extending from one end and the other end of the second surface toward the first surface, respectively, such that a distance between the third and fourth column portions increases; and a connection portion connecting end portions of the first and second column portions and end portions of the third and fourth column portions, the end portions of the first and second column portions not being in contact with the first surface, the end portions of the third and fourth column portions not being in contact with the second surface, and the first beam portion and the second beam portion are thicker than the first column portion, the second column portion, the third column portion and the fourth column portion.

* * * * *